US007216660B2

(12) United States Patent
Troian et al.

(10) Patent No.: US 7,216,660 B2
(45) Date of Patent: May 15, 2007

(54) METHOD AND DEVICE FOR CONTROLLING LIQUID FLOW ON THE SURFACE OF A MICROFLUIDIC CHIP

(75) Inventors: Sandra M. Troian, Princeton, NJ (US); Anton A. Darhuber, Princeton, NJ (US); Sigurd Wagner, Princeton, NJ (US)

(73) Assignee: Princeton University, Princeton, NJ (US)

( * ) Notice: Subject to any disclaimer, the term of this patent is extended or adjusted under 35 U.S.C. 154(b) by 131 days.

(21) Appl. No.: 10/016,294

(22) Filed: Nov. 2, 2001

(65) Prior Publication Data

US 2002/0150683 A1 Oct. 17, 2002

Related U.S. Application Data

(60) Provisional application No. 60/245,119, filed on Nov. 2, 2000, provisional application No. 60/248,860, filed on Nov. 9, 2000, provisional application No. 60/248,861, filed on Nov. 9, 2000.

(51) Int. Cl.
*F17D 1/16* (2006.01)
*F15C 1/04* (2006.01)

(52) U.S. Cl. ..... 137/13; 137/807; 137/828; 137/833

(58) Field of Classification Search ..... 137/341, 137/828, 833, 13, 807; 204/601
See application file for complete search history.

(56) References Cited

U.S. PATENT DOCUMENTS 5,814,414 A * 9/1998 Georger, Jr. et al. ..... 428/586
6,068,751 A * 5/2000 Neukermans ..... 204/601
6,103,199 A 8/2000 Bjornson et al. ..... 422/100
6,123,819 A 9/2000 Peeters ..... 204/403
6,124,138 A 9/2000 Woudenberg et al. ..... 436/518
6,284,113 B1 9/2001 Bjornson et al. ..... 204/453
6,306,273 B1 10/2001 Wainright et al. ..... 204/454
6,321,791 B1 * 11/2001 Chow ..... 137/833
6,382,254 B1 * 5/2002 Yang et al. ..... 137/807
6,520,197 B2 * 2/2003 Deshmukh et al. ..... 137/3

OTHER PUBLICATIONS

D.E. Kataoka and S.M. Troian, "Patterning liquid flow on the microscopic scale", Nature, vol. 402, Dec. 16, 1999.

A.A. Darhuber, S.M. Troian, J.M. Davis, S.M. Miller, and S. Wagner, "Selective dip-coating of chemically micropatterned surfaces", Journal of Applied Physics, vol. 88, No. 9, Nov. 1, 2000.

T.S. Sammarco and M.A. Burns, "Thermocapillary Pumping of Discrete Drops in Microfabricated Analysis Devices", AlChE Journal, vol. 45, No. 2, Feb. 1999.

* cited by examiner

*Primary Examiner*—A. Michael Chambers
(74) *Attorney, Agent, or Firm*—Mathews, Shepherd, McKay & Bruneau, P.A.

(57) ABSTRACT

The invention is directed to a method and device for routing, mixing, or reacting droplets or liquid microstreams along the surface of a flat substrate. The flow of liquid microstreams or microdroplets along designated pathways is confined by chemical surface patterning. Individually addressable heating elements, which are embedded in the substrate, can be used to generate flow via thermocapillary effects or to trigger or quench chemical reactions. The open architecture allows the liquid to remain in constant contact with the ambient atmosphere. The device can be used for microfluidic applications or as a surface reactor or biosensor, among other applications.

93 Claims, 5 Drawing Sheets

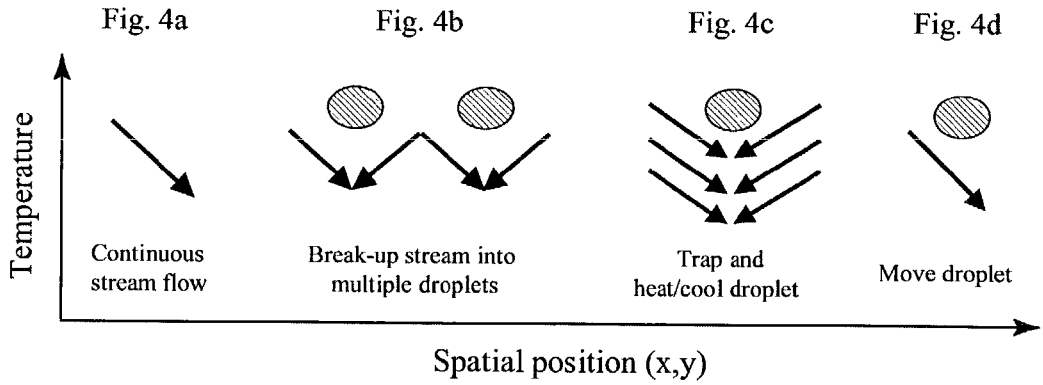
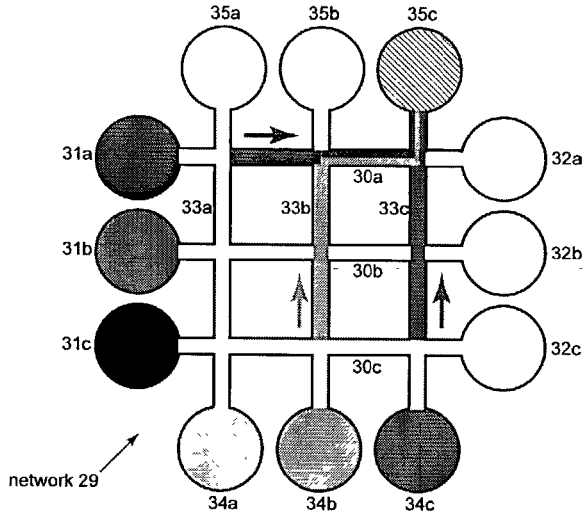
Fig. 5
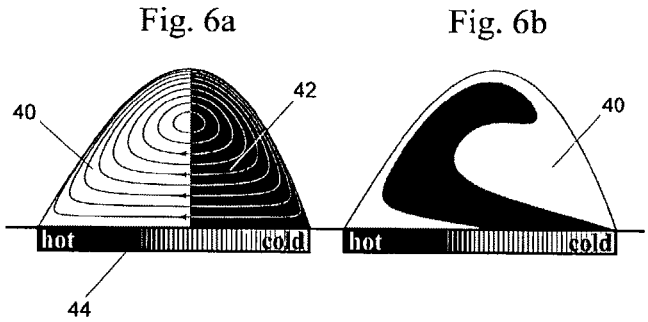
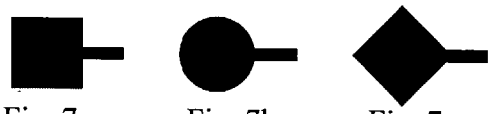
Fig. 7a Fig. 7b Fig. 7c

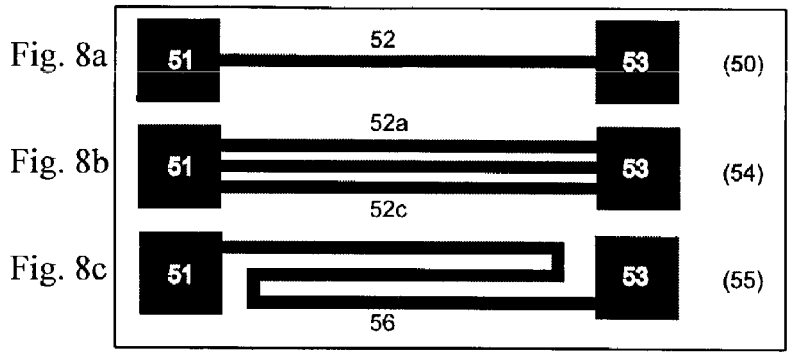
Fig. 9a
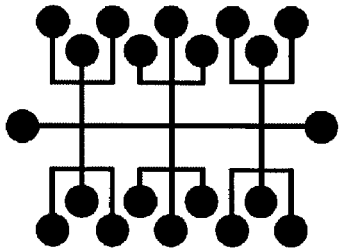
Fig. 9b
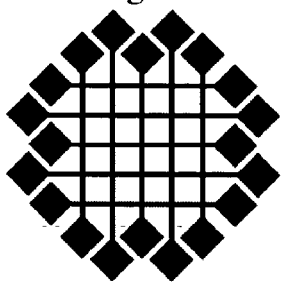
Fig. 9c
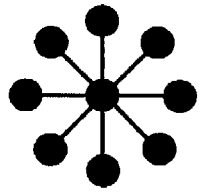
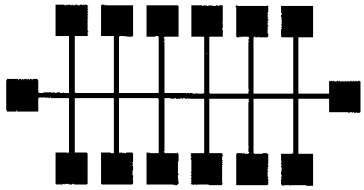
Fig. 9d
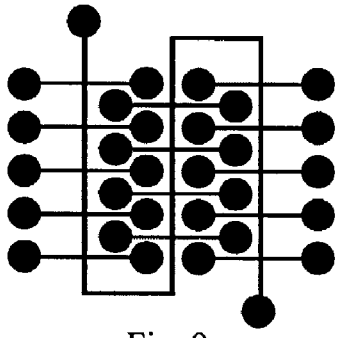
Fig. 9e
Fig. 10a
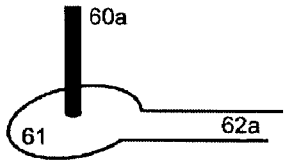
Fig. 10b
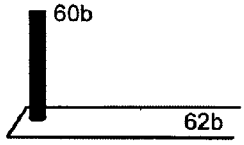
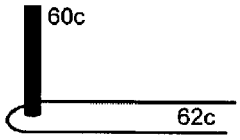
Fig. 10c
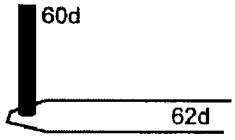
Fig. 10d
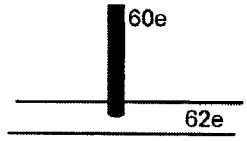
Fig. 10e

METHOD AND DEVICE FOR CONTROLLING LIQUID FLOW ON THE SURFACE OF A MICROFLUIDIC CHIP

This application claims priority of U.S. Provisional Application Ser. No. 60/245,119 filed Nov. 2, 2000, U.S. Provisional Application Ser. No. 60/248,860 filed Nov. 9, 2000 and U.S. Provisional Application Ser. No. 60/248,861 filed Nov. 9, 2000 which are hereby incorporated by reference.

BACKGROUND OF THE INVENTION

1. Field of the Invention

The present invention relates to control of liquid flows on a microfluidic chip and in particular to routing, reacting and mixing liquid microstructures on the surface of a rigid or flexible substrate using a combination of one or more of the following: high resolution temperature control at individual addressable electronic elements for generating thermocapillary flow of the liquid; surface patterning for confining the liquid at one or more particular locations on the chip; obtaining heterogeneous surfaces with hydrophilic and hydrophobic regions; and retaining hydrophilicity of surfaces.

2. Description of the Related Art

Technological developments in the miniaturization and integration of multiple functionalities for chemical analysis and synthesis into a hand held device have generated interest in developing efficient methods for transporting ultra small volumes of liquid through networked arrays. Conventional techniques include micromechanical and electric field driven methods for manipulating and controlling flow including pneumatic actuation, electro-osmotic, electrophoretic or electrowetting techniques, centrifugation and magnetic field driven pumping.

U.S. Pat. No. 6,124,138 describes a device for detecting or quantitating one or more of a plurality of different analytes in a liquid sample. The device includes a sample distribution network having a sample inlet, one or more detection chambers and a dead end fluid connection between the chambers and the inlet. A liquid sample is applied to the sample inlet and is drawn by vacuum action to deliver the sample to the detection chambers. The delivered sample reacts with at least one analyte specific reagent in each detection chamber under conditions effective to produce a detectable signal. A temperature controller can be used to heat or cool the detection chambers to facilitate reaction of the sample with the analyte detection reagents.

U.S. Pat. No. 6,306,273 describes a method for transporting a liquid in a channel of a microfluidic system by electrokinetic action in which a liquid containing material comprises a plurality of charged chemical species. A voltage is applied from one point along the channel to a different point along the channel whereby the charged chemical species are transported along the channel. Fields in the range of 200–600 V/cm are typically used to control the electro-osmotic flow.

One developed thermally based device uses thermocapillary pumping for pushing discrete liquid droplets through an enclosed microfabricated channel, as described in T. S. Sammarco and M. A. Burns, Thermocapillary Pumping of Discrete Drops in Microfabricated analysis devices [AIChE Journal45:350–366 (1999)]. This device allows discrete liquid plugs to advance through an interior channel by locally heating or cooling one of the droplet endcaps which induces a differential in capillary pressure. Micromechanical devices have the limitation that moving parts, such as miniature pumps and gears, often suffer leakage and degradation under wear. Electrokinetic and pneumatic techniques have the limitation that because the flow is confined to interior channels, particulates and aggregates in solution can block flow and destroy pumping action. Electrically based methods typically require external supply voltages of several kV. Each of the above-described devices also has the limitation of being capable of handling either continuous streams or discrete droplets but not both due to the flow mechanism on which they are based.

The mixing of liquids in microscale devices is often difficult to attain due to the absence of turbulent phenomena. Many devices therefore rely on the action of diffusion and laminar flow. It is therefore desirable to provide a method and system for routing, reacting and mixing small volumes of liquid on the surface of a substrate, without the need for moving parts, high pressure or vacuum. It would also be advantageous to operate such devices using low voltages which are compatible with conventional integrated circuits.

SUMMARY OF THE INVENTION

The invention is directed to a method and device for routing, mixing, or reacting droplets or liquid microstreams along the surface of a flat substrate. The flow of liquid microstreams or microdroplets along designated pathways is confined by chemical surface patterning. Individually addressable heating elements, which are embedded in the substrate, can be used to generate flow via thermocapillary effects or to trigger or quench chemical reactions. The open architecture allows the liquid to remain in constant contact with the ambient atmosphere. The device can be used for microfluidic applications or as a surface reactor or biosensor, among other applications.

Thermocapillary actuation is based on the surface stress created by variations in surface tension at a gas-liquid or liquid-liquid interface. Variations in surface tension are created by temperature differences along such interfaces which can be directly applied by contacting the liquid to a differentially heated surface. For sufficiently thin liquid films in which the overlying fluid is a gas, the thermal map applied to the substrate is reproduced at the gas-liquid interface.

In an embodiment of the present invention, a liquid is received on a patterned surface comprising one or more pathways. The patterned surface can be formed of one or more hydrophobic regions confining a hydrophilic surface in which the liquid flows along the hydrophilic surface. One or more of a plurality of heating elements are in registry with the patterned surface. The heating elements are individually activated under conditions effective for routing the fluid on the patterned surface. The activated heating elements form a thermal map. In an embodiment of the present invention, activation of the thermal map divides a liquid stream into one or more droplets. In another embodiment, activation of the thermal map initiates or quenches a reaction. In another embodiment, activation of the thermal map effects mixing of two or more streams or two or more droplets. Alternatively, activation of the thermal map traps or releases one or more droplets.

In one aspect of the present invention, an airborne material is absorbed in liquid received on the device. The airborne material is detected in the liquid. In a further aspect, a method is described for fabrication of the device. In another aspect, a method is described for forming refreshable hydrophobic and hydrophilic surfaces. The refreshable surfaces can be used with the device of the present invention. In another aspect a method is provided for storing the device.

The invention will he more fully described by reference to the detailed description when read in light of the following drawings.

BRIEF DESCRIPTION OF THE DRAWINGS

FIG. 4*a* is a diagram of an electronically controlled thermal map for providing flow of a continuous stream of fluid by application of a linearly decreasing temperature profile.

FIG. 4*b* is a diagram of an electronically controlled thermal map for dividing a continuous stream of liquid into droplets by application of a zig-zag shaped temperature profile.

FIG. 4*c* is a diagram of an electronically controlled thermal map for droplet isolation and trapping and subsequent heating or cooling.

FIG. 4*d* is a diagram of an electronically controlled thermal map for moving a previously trapped droplet.

FIG. 5 is a plan view of a possible network of hydrophilic surface pathways.

FIG. 6*a* is a schematic diagram of an initial conformation of two liquids to be mixed which are supported on a differentially heated substrate.

FIG. 6*b* is a schematic diagram of thermocapillary driven mixing of two fluids enforced by an electronically controlled differentially heated substrate.

FIG. 7*a* is a schematic diagram of a square shaped hydrophilic reservoir.

FIG. 7*b* is a schematic diagram of a circular shaped hydrophilic reservoir.

FIG. 7*c* is a schematic diagram of a diamond shaped hydrophilic reservoir.

FIG. 8*a* is a schematic diagram of a network comprising a linear pathway connecting a source and target reservoir.

FIG. 8*b* is a schematic diagram of a network of a plurality of linear pathways connecting a source and target reservoir.

FIG. 8*c* is a schematic diagram of a sinuous pathway connecting a source and target reservoir.

FIG. 9*a* is a schematic diagram of a network including a plurality of vertical pathways having a plurality of reservoirs interconnected to a horizontal pathway.

FIG. 9*b* is a schematic diagram of a network comprising rectilinear intersecting pathways.

FIG. 9*c* is a schematic diagram of a network comprising a radial arrangement of pathways.

FIG. 9*d* is a schematic diagram of a network including a plurality of vertical pathways intersecting a horizontal pathway.

FIG. 9*e* is a schematic diagram of a plurality of horizontal pathways connected by an intersecting sinuous pathway.

FIG. 10 is a schematic diagram of various dispensing geometries for introducing fluid onto hydrophilic pathways.

DETAILED DESCRIPTION

Figure 1:
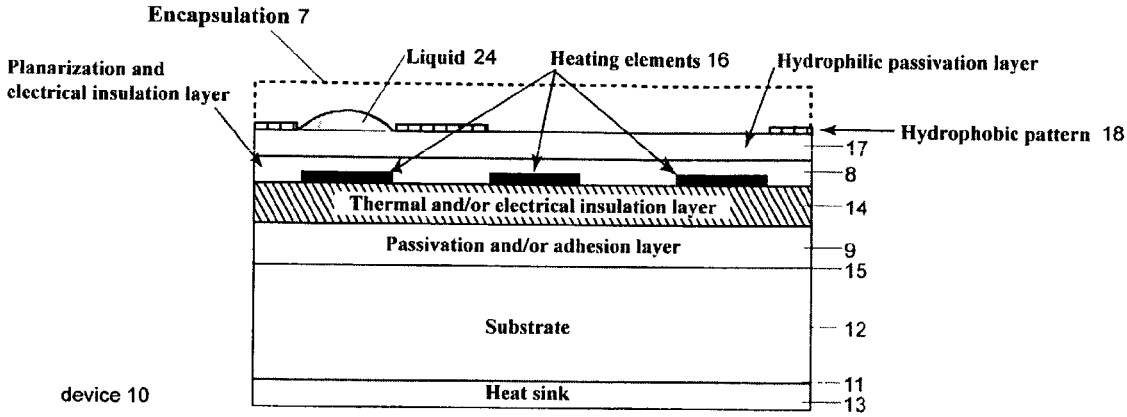
FIG. 1 is a cross section of one embodiment of the thermal fluidic device in accordance with the teachings of the present invention.

The following terms and phrases as used herein are intended to have the meanings below. The term "surface pathways" refers to either a flat topology with chemical patterning or an indentation, ridge or groove optionally having chemical patterning. The term "hydrophilic pathways" refers to hydrophilic lanes surrounded by hydrophobic regions such that an appropriate liquid sample will remain confined to the hydrophilic portions. The hydrophilic pathways can be flush with the hydrophobic layer or include ridges or grooves.

The term "hydrophilic" refers to a surface which is either completely or partially wetted by the liquid sample, in contrast to a hydrophobic surface on which the liquid assumes a contact angle exceeding ninety degrees. The contact angle is defined at the interior tangent angle of the air-liquid interface at the three phase boundary consisting of the gas, liquid and solid phases.

Reference will now be made in greater detail to embodiments of the invention, examples of which are illustrated in the accompanying drawings. Wherever possible, the same reference numerals will be used throughout the drawings and the description to refer to the same or like parts.

FIG. 1 illustrates a cross-sectional view of an exemplary device 10 in accordance with the teachings of the present invention. Device 10 includes substrate 12. Substrate 12 can be formed of any solid material whether rigid or flexible which is suitable for use in combination with components described below. Exemplary suitable materials for substrate 12 include various plastic polymers and copolymers, such as polypropylene, polystyrenes, polyimides and polycarbonates. Substrate 12 can also be formed of inorganic materials such as glass, metal or silicon. Substrate 12 can be formed from a single material or from a plurality of materials.

Surface 11 of substrate 12 is coupled to heat sink 13. Heat sink 13 can be formed of any heat transfer device capable of removing heat from device 10. For example, heat sink 13 can be a Peltier cooler device or a metal block cooled by a steady internal flow of coolant.

Passivation layer 9 can be optionally coupled to surface 15 of substrate 12 to provide a reproducible surface for subsequent processing steps or to improve the mechanical adhesion of subsequently deposited layers.

Insulator layer 14 can be optionally coupled to surface 15 of substrate 12 or passivation layer 9. Insulator layer 14 can be formed of a material suitable for providing thermal and/or electrical insulation. Alternatively, if substrate 12 is formed of a material with low thermal conductivity, insulator layer 14 is not required. Examples of suitable materials for insulator layer 14 include polyimides or other polymeric or organic materials, as well as organic or inorganic porous materials.

A plurality of heating elements 16 are deposited onto insulator layer 14 or directly onto substrate 12, if insulator layer 14 is not used. Planarization and electrical insulation layer 8 is deposited over heating elements 16 and exposed surfaces of insulation layer 14 or substrate 12. Heating elements 16 are embedded in insulation layer 8. Patterned surface layer 18 is in registry with heater elements 16.

Patterned surface layer 18 can include hydrophobic portions patterned on a hydrophilic layer. Optionally planarization aspect of layer 8 can be deposited on top of heater elements 16 if a flat surface topology is desired for subsequent processing or device operation. For cases in which the liquid being transported is volatile, the device can be encapsulated with an overlying glass or plastic containing surface 17 whose interior region may be saturated to reduce evaporation.

Liquid microstructures contact the hydrophilic regions of patterned surface layer 19 as described in more detail below. Suitable liquids include, but are not limited to water, glycerol, tetra(ethylene glycol), polydimethylsiloxane, organic solvents, cell cultures, animal or human bodily fluids, solutions comprising suspended particles, solutions comprising biological molecules, cellular cytoplasm, cellular extracts, cellular suspensions, solutions of labeled particles or biological molecules, solutions comprising liposomes, encapsulated material, or micelles, etc. In another embodiment of the invention, the liquid can further contain solid particulates or other droplets, as in a liquid emulsion. By way of example, but not by way of limitation, particulates are any polymer particle, such as polystyrene particles or beads, metal colloids (e.g., gold colloidal particles), magnetic particles, dielectric particles, nanocrystals of materials, and bioparticles, such as spores, pollen, cellular oclusions, precipitates, intracellular crystals, etc. In possible embodiments of the invention, the particles are in the nanometer and/or micrometer size range, for example, but not limited to, from about 1 nm to about 100 μm.

In still another embodiment of the invention, the liquid contains biological molecules, such as but not limited to, polynucleotides such as DNA and RNA, polysaccharides, polypeptides, proteins, lipids, and any other cellular components.

In an embodiment of the invention, the liquid comprises viruses, such as but not limited to, viruses capable of infecting any organisms including microorganisms, plants or animals, in particular, mammals and especially humans. Further viruses in the categories of viruses with or without coat and viruses categorized as DNA or RNA viruses, either double stranded or single stranded are encompassed by the present invention.

In yet another embodiment, liquid further comprises one or more biological cells which are capable of being routed, mixed or reacted with species present on device 10. The biological cells are either procaryotic and/or eucaryotic cells. Examples of procaryotic cells include, but are not limited to, bacteria, microorganisms, etc. Examples of eucaryotic cells are, but not limited to, fungal, plant and animal cells for instance mammalian cells or human cells. In more particular embodiments, the mammalian or human cells may be cells for example, from blood, liver, kidney, lung or any other tissue or organ. In another preferred embodiment, the cells are tumor or cancer cells, which can be either benign or malignant cancer cells.

In a typical embodiment of the thermal fluidic device, the width of the patterned hydrophilic pathways will range from a few micrometers to hundreds of micrometers. Liquid samples deposited onto the reservoirs or hydrophilic pathways can range from less than a microliter to tens of microliters. The liquids flowing along the hydrophilic pathways can range in thickness from about a micron to tens or hundreds of microns, depending on the degree of hydrophobicity of the surrounding material. The more hydrophobic is the surrounding surface to the hydrophilic liquid, the thicker the liquid stream or droplet that can be confined by the chemical patterning. A range of thermal gradients can be applied to the chemcially patterned surface so long as the liquid does not substantially evaporate or boil. Typical thermal gradients can range from a few degrees per centimeter to tens of degrees per centimeter. The speed of the flowing liquid depends on material properties like the liquid surface tension, the variation of surface tension with temperature and the liquid viscosity. The speed also depends on the magnitude of the applied thermal variation with distance (i.e. the local or global thermal gradient), as well as geometric features of the device like the surface area of the reservoir (which controls the volume of sample deposited), the width, length and shape of the hydrophilic pathway connecting source to target. Studies with liquids like tetraethylene glycol can produce speeds in the range of 600 micrometers per second. Designs with geometric and chemical patterning techniques that allow thicker films to flow onto a hydrophilic pathway can produce speeds of the order of a millimeter per second.

Figure 2:
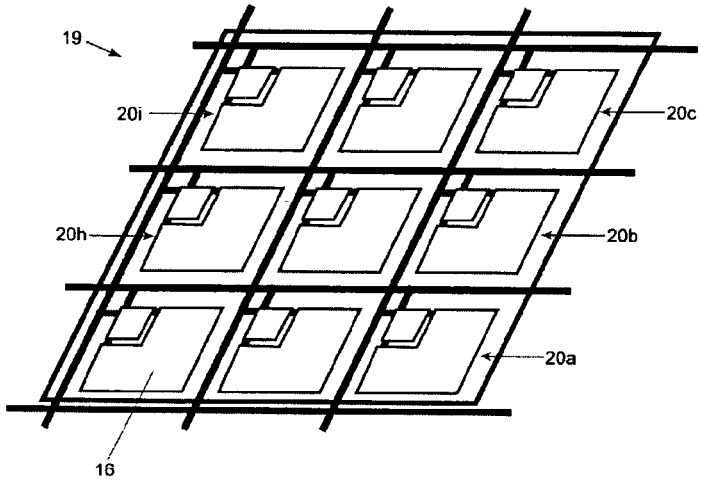
FIG. 2 is a schematic diagram of an embodiment of an arrangement of heating elements in an active-matrix array including an electronic addressing scheme.
Figure 3:
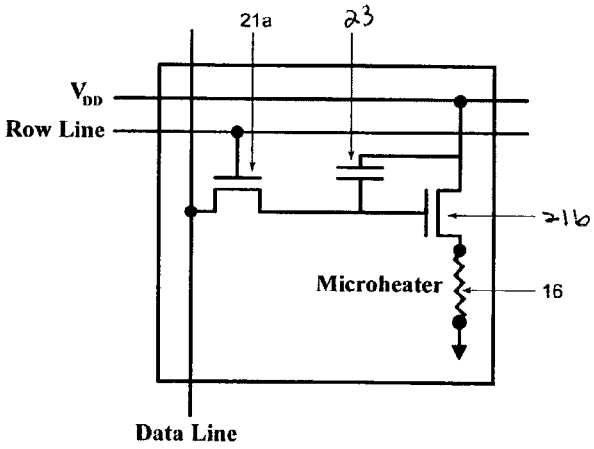
FIG. 3 is a schematic diagram of one embodiment of a heater cell in an active-matrix array.

FIG. 2 illustrates an arrangement of heating elements 16 in array 19. Array 19 comprises a plurality of cells 20 arranged in a matrix configuration. As shown in FIG. 3, each individual cell 20 can be an integrated circuit comprising one or more transistors 21, capacitors 21*b* and microheating elements 16. Each heating element 16 sets the temperature of a respective cell 20. Each cell 20 is addressed by thin film transistor switch 21*a*. Transistor 21*a* switches power to capacitor 21*b* and transistor 23. Voltage on transistor 23 sets current through capacitor 23 thereby regulating its temperature heating element 16. In this embodiment, the matrix configuration is a 3-by-3 matrix. It will be appreciated that alternate size matrices can be used depending on the size of device 10 or the desired configuration of a thermal map associated with the matrix configuration. Heating elements 16 are selected to have a predetermined size dependent on the desired size of device 10 and the desired positional resolution of the temperature profile. For example, heating elements 16 typically can have a width in the range of about 1 micron to about 5 mm. VDD is a power supply voltage to cell 20. Liquid streams or droplets can be moved from one cell 20 to another cell 20 with a speed determined by the applied thermal map, the liquid viscosity, the surface tension and the variation in surface tension with temperature. Cells 20 can be activated at a rate faster than the rate of fluid motion in order to establish the temperature of each cell 20 ahead of the fluid response. Liquid 24 responds by flowing from cells at higher temperature to cells at lower temperature.

Alternative thermal maps can be applied to effect conformational changes to a liquid stream controlled by device 10 as shown schematically in FIGS. 4*a*–*d*. The vertical axis is the temperature at a particular location (x,y) on the surface of device 10. FIG. 4*a* describes the type of thermal map which will provide continuous streaming of a liquid rivulet or droplet across a series of cells 20. FIG. 4*b* describes the action of a saw-tooth temperature profile which will divide a liquid rivulet into a series of discrete droplets. These droplets may be monodisperse or not depending on the particular thermal pattern applied and the lateral extent of the heating elements. FIG. 4*c* describes a thermal map for isolating and trapping a discrete droplet and subsequent heating and cooling to initiate or quench a chemical reaction. After the droplet has been appropriately manipulated, the thermal map shown in FIG. 4*d* can be applied for release and further migration onto another cell 20, a reservoir or exit port from the device.

In one embodiment of the present invention, surface layer 18 is patterned with network 29 of intersecting pathways, as shown in FIG. 5. Surface layer 18 can be formed of a hydrophilic material for forming hydrophilic pathways between hydrophobic regions.

Horizontal pathways 30*a*–30*c* extend respectively between reservoirs 31*a*–31*c* and reservoirs 32*a*–32*c*. Vertical pathways 33*a*–33*c* extend respectively between reservoirs 34*a*–34*c* and reservoirs 35*a*–35*c*. Each of horizontal pathways 30*a*–30*c* intersects vertical pathways 33*a*–33*c*. A matrix of cells can be in registry with horizontal pathways 30*a*–30*c* and vertical pathways 33*a*–33*c* for controlling flow from respective reservoirs (not shown). First reagent 36*a* is dispensed into reservoir 34*b* and second reagent 36*b* is dispensed from reservoir 34*c*. First reagent 36*a* can be the same or different than second reagent 36*b*. Third reagent 36*c* is dispensed from reservoir 30*a*. Each of first reagent 36*a*, second reagent 36*b* and third reagent 36*c* flows toward fluid reservoir 35*c*. First reagent 36*a* and third reagent 36*c* flow in pathway 30*a* and are mixed with one another to form a homogeneous composition. Second reagent 36*b* flows into pathway 33*c* and is mixed with the mixture of first reagent and third reagent 36*c* flowing in pathway 33*c* toward reservoir 35*c* to form a homogeneous composition. A chemical reaction between two or more of reagents 36*a*–36*c* or an entity such as a molecule, particle or droplet immobilized in one of channels 30*a*, 33*c* or reservoir 35*c* can occur spontaneously or can be induced by activation of one or more heating elements in registry with pathways 30–30*c* and 33*a*–33*c*. It will be appreciated that various reagents can be dispensed from one or all of the pathways in network 29.

Liquid mixing can be achieved by placing liquid in contact with a differentially heated substrate. FIG. 6*a* is a cross sectional view illustrating the mixing of two liquids, 40 and 42, residing on a hydrophilic region. Liquids 40 and 42 represent cross-sectional views of a discrete droplet or a liquid rivulet. In the absence of a lateral thermal gradient on substrate 44, liquid 40 and 42 can only mix by interdiffusion. In the presence of a lateral thermal gradient on substrate 44, liquids 41 and 42 mix by thermocapillary induced forcing to produce the mixing pattern shown in FIG. 6*b*. For the case of a liquid made to flow by application of an additional thermal gradient perpendicular to the first, the spiral pattern shown will evolve into a helical one. The creation of additional interfacial area between liquids 40 and 42 produces significantly faster mixing. Reservoirs containing liquids to be dispensed can be patterned into a variety of shapes as illustrated in FIGS. 7*a*–7*c*. Exemplary shapes include a square, circle or diamond. These can also be combined to produce rectangles, polygonal or curvilinear shapes.

Alternative geometric layouts for surface pathways connecting two reservoirs are illustrated in FIGS. 8*a*–8*c*. Network 50 represents a linear pathway 52 connecting reservoir 51 to 53. Network 54 includes three linear pathways 52*a*–52*c* connecting reservoir 51 to 53, as shown in FIG. 8*b*. Network 55 consists of a sinuous pathway 56 connecting reservoir 51 to 53, a shown in FIG. 8*c*. Networks can comprise a source and a target reservoir connected by one or more pathways. The pathways can be rectilinear or curvilinear. The subsurface heater elements 16 are placed in registry with the network to achieve the desired flow pattern. The minimum number of heater elements required for controlling the flow of liquid into or out of a reservoir connected to N pathways equals N+1. One heater element is used for uniformly heating or cooling the reservoir pad while the remaining N heater elements function as valves to prevent or promote migration along the N pathways. The number of heater elements 16 used for controlling the flow of liquid along a pathway depends on the length L of the pathway and the desired spatial resolution D.

FIGS. 9*a*–9*e* represent schematic diagrams of possible network variants connecting sets of reservoirs. FIG. 9*a* illustrates a network including a plurality of vertical pathways having a plurality of reservoirs interconnected to a horizontal pathway. FIG. 9*b* illustrates a schematic diagram of a network comprising rectilinear intersecting pathways. FIG. 9*c* illustrates a network comprising a radial arrangement of pathways. FIG. 9*d* illustrates a network including a plurality of vertical pathways intersecting a horizontal pathway. FIG. 9*e* illustrates a plurality of horizontal pathways connected by an intersecting sinuous pathway. It will be appreciated that networks can be arranged in alternative patterns or any combination of patterns for defining a desired flow of liquid in device 10 in accordance with the teachings of the present invention.

Liquid samples can be introduced onto device 10 by using a variety of contact or non-contact dispensing techniques. In addition, the liquid sample can be placed onto a reservoir or injected directly onto a pathway. One non-contact dispensing method is ink-jetting. Contact dispensing methods include pin tool spotting, pressurized capillary tubes or syringe tips. FIG. 10*a* illustrates a sample deposition tool 60 delivering material onto a circular reservoir pad 61. FIGS. 10*b*–*e* represent liquid deposition directly onto respective pathways 62*b*–*e*. The pathways can have square, round or tapered edge termination.

Figure 11A:
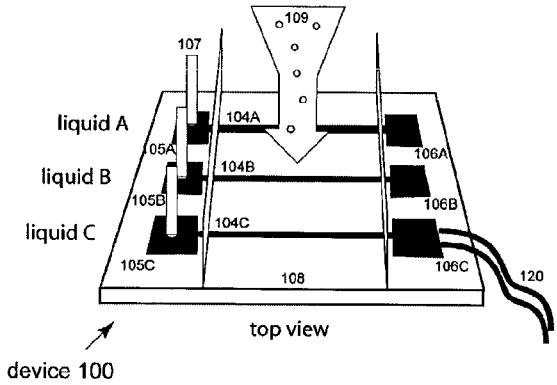
FIG. 11*a* is a plan view of one embodiment of the thermal fluidic device as a gas sensor or biosensor.
Figure 11B:
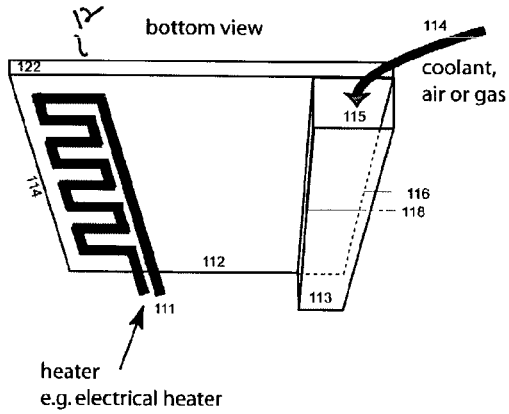
FIG. 11*b* is a bottom view of one embodiment of the thermal fluidic device as a gas sensor or biosensor.

FIGS. 11*a*–11*b* illustrate an exemplary use of device 100 in accordance with the teachings of the present invention for detecting airborne chemicals in gaseous, particulate or aerosol form by absorption onto a liquid surface. Device 100 comprises network 102 which comprises rectilinear pathways 104*a*–104*c* between respective source reservoirs 105*a*–105*c* and target reservoirs 106*a*–106*c*.

Input 107 dispenses one or more reagents to one or more of source reservoirs 105–105*c*. For example, input 107 can be a microsyringe. Network 102 resides on surface 108. Liquids received on network 102 can absorb airborne chemical species 109 while flowing on pathways 104*a*–104*c*. The liquid flow is enforced via differential heating from source reservoir 105 to target reservoir 106. This differential heating is accomplished through heat source 111, which is coupled to bottom surface 112 at edge 114, and heat sink 113 located at edge 116 of device 100. Heat sink 113 can be formed by flowing coolant substance 117 through interior 115 of metal tube 118. If substrate 122 is formed of silicon or a metal, a linear temperature profile can be made to develop along pathways 104*a*–104*c*. Other temperature profiles are possible in accordance with the teachings of the present invention.

Heat source 111 is placed in registry with source reservoirs 105*a*–105*c*. Heat source 111 can be a single activated heat source such as a flexible metal heater insulated with Kapton foil (e.g. Omega Engineering Inc. model KHLV-0502/10-P). Heat source 111 can be attached to bottom surface 112 of substrate 122 by means of glue or adhesive material. Alternatively, for transport along more curvilinear pathways 104, the differential heating can be accomplished through a plurality of cells 20 or heater elements 16 which are located beneath pathways 104 and individually electronically activated.

Device 100 and device 10 can be utilized with a number of detection schemes. One such method can include deposition of various inhibited fluorescent liquid compounds onto reservoirs 105*a–c* which when contacted by an airborne agent either emit light directly or can be made fluorescent by further optical excitation. The fluorescence can be detected by optical sensors 120. A suitable optical detector assembly 120 comprise a laser diode, optical filters and a light detector probing target reservoirs 106*a*–106*c*. Alternatively, optical sensors can be positioned along one or more of pathways 104*a*–104*c*. Other detection methods can include monitoring color changes(with or without fluorescence), electrical conductivity, refractive index, light absorption, or temperature. Electrochemical detectors can also be used. It will be appreciated that alternative methods for detecting airborne species could be used in accordance with the teachings of the present invention. The species can be introduced onto device 100 by passive absorption or by convective gas streams running perpendicular to pathways 104*a–c*.

Figure 12:
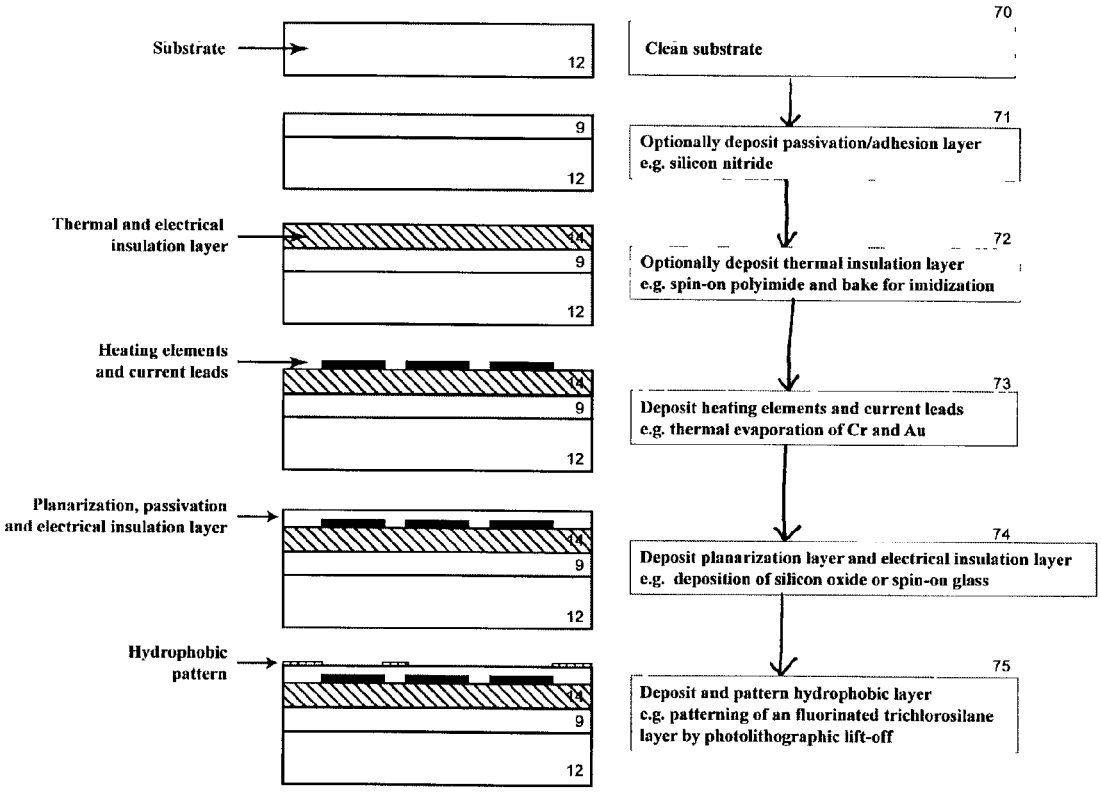
FIG. 12 is a flow diagram of an exemplary process for fabrication of the device.

FIG. 12 is a flow diagram of an exemplary process for fabrication of device 10 and corresponding results of each of the steps. In this description of the fabrication process flat topologies are used. The initial cleaning of substrate 12 is shown in block 70. The particular cleaning procedure is dependent on the substrate material. For instance, glass can be cleaned by ultrasonic agitation in organic solvents and immersion in sulphuric acid and hydrogen peroxide. Block 71 represents the optional deposition of a passivation or adhesion layer 9. This can be accomplished, for example, by spin coating a thin layer of spin-on glass or chemical vapor deposition of silicon nitride. This layer serves to promote adhesion of insulation layer 14 to substrate 12 or to create a reproducible and well characterized (i.e. passivated) surface on top of which subsequent layers can be deposited. Block 72 represents an optional thermal and insulation layer which, for example, can be accomplished by spin coating a thin layer of polyimide which is then baked for imidization. This layer reduces the power input required to maintain a desired temperature distribution and prevents electrical contact between heating elements 16 and substrate 12. Block 73 depicts the deposition of heating elements 16. Heating elements 16 can be micropatterned including current leads for power input. Heating elements 16 can be formed of a conductive metal such as titanium, platinum, gold or chromium, or a non-metallic conductor such as silicon or indium tin oxide Heating elements 16 can be deposited by photolithographic patterning of a photoresist layer and subsequent pattern transfer into the resistive heating material. Alternatively, heating elements 16 can be deposited by thermal evaporation of the metallic or non-metallic conductor or by other deposition methods.

In block 74, electrical insulator layer 17 is deposited over heating elements 16 and insulating layer 14 or substrate 12. For example, electrical insulator layer 17 can be deposited as a layer of silicon oxide. An additional planarization and/or passivation layer 8 can be introduced to provide a smooth, flat and reproducible surface for subsequent hydrophilic/hydrophobic surface patterning. Electrical insulator layers 17 and/or passivation layer 8 provide additional protection of device 10 from moisture invasion. An exemplary method for performing planarization is by depositing a material such as a polymeric material or spin on glass onto heating elements 16 and insulator layer 14 or substrate 12. An implementation of a passivation layer includes plasma enhanced deposition of a silicon nitride passivation layer. In an alternate method, the fabrication method starts with substrate 12 including cells comprising transistors 21 and leads for a matrix addressing scheme of cells 20. Before deposition of heating elements 16, contacts through insulator layer 14 and electrical insulation layer 17 are formed. Alternatively, heating elements 16 can be formed below insulator layer 14.

Block 75 depicts a chemical patterning step of surface 18. In one embodiment surface 18 is first prepared to be completely hydrophobic. Thereafter, surface 18 is then selectively patterned to reveal hydrophilic regions such as reservoirs 105 and 106 or pathways 104. The chemical patterning step, however, need not be subtractive, as described below. An additive method in which the hydrophilic layer 18 is selectively stamped with hydrophobic material to produce a surface of mixed wettability. Surfaces of mixed wettability comprising hydrophilic and hydrophobic regions are used to confine and direct liquids on substrates such as glass, silicon, Kapton and other polymeric materials. In one embodiment, hydrophilic or hydrophobic surface patterns are used to form networks in device 10. Hydrophilic and hydrophobic surface patterns can be fabricated to be refreshable for re-establishing the coating after it has been removed, such as by mechanical abrasion or chemical attack induced by repeated use.

Figure 13:
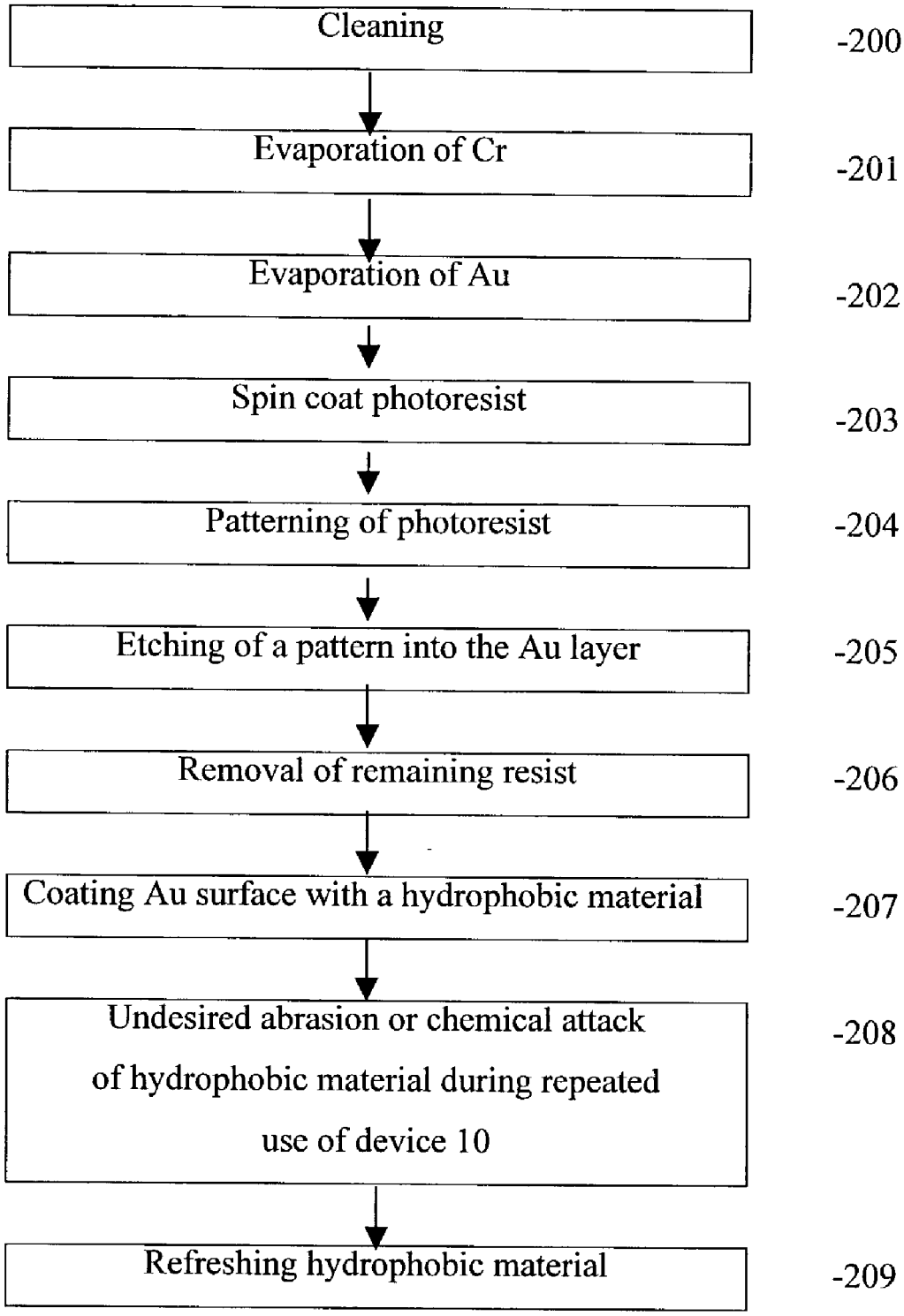
FIG. 13 is a flow diagram of a method for forming a refreshable hydrophobic surface pattern.

Conventional methods for creating hydrophobic surfaces include silanization or thiolization. Treatment with organic solutions containing octadecyltrichlorosilane or perfluorinated compounds, such as fluorinated trichlorosilane, produce strongly hydrophobic surfaces on which water droplets assume contact angles in excess of about 90 degrees. FIG. 13 illustrates a hydrophobizing scheme which uses alkylthiol compounds on gold. An attractive feature of this method is that undesired abrasion or chemical attack resulting from repeated use of the device can be healed by simply refreshing the hydrophobic portions of surface 18 comprising the gold coated regions. Only these regions attract and bind the thiolized solution. Patterning of the hydrophobic layer can be performed by photolithography, reactive ion etching in an oxygen plasma or exposure to ultraviolet light.

The flow diagram shown in FIG. 13 can in practice also be used independently of device 10 for uses requiring liquid sample confinement on a substrate containing no heating elements. It can also be used on surfaces which are uniformly heated or cooled as in a microreactor plate. The flow diagram illustrates the method for fabricating refreshable hydrophilic and hydrophobic surface patterns. These process steps can also be performed on top of layer 17 following the process step shown in block 74.

In block 200, surfaces of the material on substrate 12 are cleaned. In an embodiment of the device, substrate 12 is a silicon wafer or glass plate. The material on substrate 12 can be immersed in sulfuric acid, hydrogen peroxide and deionized water at elevated temperatures. Cleaning of polymeric materials requires reagents compatible with the chemical resistance of the material on substrate 12. In block 201, a layer of Cr is evaporated. The layer of Cr can have a thickness between about 1 and about 10 nanometers. In block 202, a layer of Au is evaporated. This layer of Au can have a thickness between about 1 to about 500 nm. In block 203, photoresist is spin coated onto the Au coated surface. In block 204, the photoresist is patterned by application of a mask and photolithographic processing for developing the exposed photoresist. In block 205, a pattern is etched into the Au layer. A suitable etching technique can be wet chemical etching (TFA from Transene Comp. Inc). In block 206, any remaining photoresist is removed. In block 207, the Au surface is coated with a hydrophobic material. Suitable hydrophobic substances include alkylthiols like hexadecanethiol. A monolayer of this material can be applied by immersion of the Au surface into a solution of alkylthiol in ethanol. The thiol molecules are known to bond selectively to Au surfaces. The thiol molecules will not bond to substrates such as glass, silicon or Kapton. In block 208, if any of the hydrophobic material is removed by mechanical abrasion or chemical attack, the gold surface can then be reimmersed into the hydrophobic solution for material selective refreshing of the hydrophobic coating.

In an alternate method of fabricating refreshable surface patterns, blocks 201–205 can be substituted with a lift off process in which a layer of photoresist is patterned before the metal coating is evaporated. Alternatively, titanium can be used in step 201 and evaporated by the use of an electron beam evaporator.

The hydrophilicity of a chemcially patterned substrate can be maintained by storing it in glycerol ($C_3H_5(OH)_3$, 1,2,3-propanetriol). The glycerol can be applied by brushing, dipcoating or other coating technique. Once coated with a layer of glycerol, device 10 can be stored without degradation or organic contamination of the hydrophilic regions for extended periods of time. Upon use, the glycerol coating can be removed by washing the surface with deionized water and drying by a filtered gas stream like dry nitrogen. Glycerol does not adhere to hydrophobic coatings and does not readily evaporate at room temperature. If the glycerol coated substrates are placed in a refrigerated environment, the glycerol will thicken to produce a gel-like protective coating. Since glycerol is hygroscopic, storage in an airtight container is preferable.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

The thermal fluidic device described above can be used for applications involving functional genomics and recombinant DNA methods. It can also be used for microarray immunoassays in microfluidic triage protein chips.

The invention described is also broadly applicable as a diagnostic and/or synthetic tool. Unlike other microfluidic technologies, its design enables manipulation, transport, and analysis of both droplets and continuous streams. It also uses only one single mechanism (i.e. an addressable thermal matrix array) to enforce precise dosing, transport, mixing and chemical reactions. Allowing multiple and parallel reactions, the chip is ideally suited to the synthesis and screening of specialized inorganic, organic or genomic materials in the nano- to picoliter range by spatial and temporal multi-step manipulation of droplets. The manipulation and control of liquid samples can be used for fundamental studies, like the interrogation and modification of rate constants, molecular activity and macromolecular conformation and phase changes in ultraconfined geometries in a completely automated manner producing quantities in the nano- to picoliter range. The device can also be used as a micro or nano-synthesis plate in which multiple organic or inorganic materials can be combined to form novel materials.

The invention described can also be used in combination with more traditional lab-on-a-chip devices which typically use pneumatic or electrokinetic mechanisms for flowing, sorting, sizing and quantitating biological material like nucleic acids. It also lends itself to high throughput applications.

EXAMPLE

Example I

Prototypes for the sensor device depicted in FIGS. 11*a* and 11*b* have been fabricated using the following process steps:

1. Cutting of silicon wafers into 2-by-2 inch pieces.
2. Cleaning of silicon samples by rinsing with or ultrasonication in tetrachlorethylene, acetone and isopropanol.
3. Further cleaning of silicon samples by immersion into a mixture of sulfuric acid, hydrogen peroxide and deionized water at a temperature of 80° C. for 20 minutes.
4. Deposition of a 120 nm thick layer of silicon dioxide by plasma enhanced chemical vapor deposition using a Plasmatherm 790 at a temperature of 250° C.
5. Deposition of a 120 nm thick layer of silicon nitride by plasma enhanced chemical vapor deposition using a Plasmatherm 790 at a temperature of 250° C.
6. Deposition of a 120 nm thick layer of silicon dioxide by plasma enhanced chemical vapor deposition using a Plasmatherm 790 at a temperature of 250° C.
7. Spin coating of a layer of photoresist (AZ5214 at 4000 rpm for 40 seconds), exposure to UV radiation in a Karl Suess MJB3 mask aligner with a photolithographic mask for the heating electrodes and development of photoresist using a Clariant 400k developer
8. Evaporation of 5 nm thick layer of titanium, a 120 nm thick layer of Au and a 5 nm thick layer of Cr using a Denton electron beam evaporator.
9. Removal of resist by immersion into acetone, which leaves the desired metal heater and contact pads on the surface.
10. Deposition of a 600–800 nm thick silicon dioxide layer by plasma enhanced chemical vapor deposition using a Plasmatherm 790 at a temperature of 250° C. with electrical contacts masked.
11. Spin-coating of a layer of photoresist (AZ5214 at 4000 rpm for 40 seconds), exposure to UV radiation in a Karl Suess MJB3 mask aligner with a photolithographic mask for straight parallel hydrophilic channels and development of the photoresist using Clariant 400k developer.
12. Immersion of sample in a dilute (1 mM) solution of 1H,1H,2H,2H-perfluorooctyltrichlorosilane in dodecane for 5 min.
13. Removal of sample from solution and sonication of sample in dodecane for 1–5 minutes.
14. Sample dried in stream of filtered nitrogen gas followed by a water rinse.
15. Rinsing of sample with acetone to remove photoresist.
16. Immersion of sample in Bakerstrip 1000 at a temperature of 60° C. for 5 minutes.
17. Rinsing of sample with acetone and isopropanol.
18. Removal of silicon dioxide and chromium on top of contact pads using chromium etchant CR-7
19. Soldering of contact pads with In-solder.
20. Cleaning of hydrophilic regions with a dilute solution of sulfuric acid and hydrogen peroxide in deionized water.
21. Powering heating resistor with DC-power supply.
22. Placing edge of sample opposite to heater wire on water cooled brass block.
23. Deposition of hydrophilic liquid on the hydrophilic regions produces controllable and predictable liquid flow.

Example II

Another prototype for the sensor device depicted in FIG. 1*b* and 1*c* has been fabricated using the following process steps:

1. Cutting of silicon wafers in 2-by-2 inch pieces
2. Cleaning of silicon samples by rinsing with or ultrasonication in tetrachlorethylene, acetone and isopropanol
3. Further cleaning of silicon samples by immersion into a mixture of sulfuric acid, hydrogen peroxide and deionized water at a temperature of 80° C. for 20 minutes.
4. Spin-coating of a layer of photoresist (AZ5214 at 4000 rpm for 40 seconds), exposure to UV radiation in a Karl Suess MJB3 mask aligner with a photolithographic mask for straight parallel hydrophilic channels and development of the photoresist using Clariant 400k developer
5. Immersion of sample in a dilute (1 mM) solution of 1H,1H,2H,2H-perfluorooctyttrichlorosilane in dodecane for 5 ml.
6. Removal of sample from solution and sonication of sample in dodecane for 1–5 minutes.
7. Sample dried in filtered nitrogen gas stream followed by a water rinse.
8. Rinsing of sample with acetone to remove photoresist.
9. Immersion of sample in Bakerstrip 1000 at a temperature of 60° C. for 5 minutes
10. Rinsing of sample with acetone and isopropanol
11. Removal of silicon dioxide and Cr on top of contact pads using chromium etchant CR-7
12. Soldering of contact pads with In-solder
13. Cleaning of hydrophilic regions with a dilute solution of sulfuric acid and hydrogen peroxide in deionized water
14. Place one edge of sample on heated, temperature controlled brass block.
15. Place opposite edge of sample on water cooled brass block.
16. Deposition of hydrophilic liquid on the hydrophilic regions produces controllable and predictable liquid flow. Proof of concept of this device was accomplished with a surface network consisting of a parallel set of rectilinear hydrophilic stripes each connecting two diamond shaped reservoirs. Only one resistive heater was patterned on the underside of a silicon substrate. The resistive heater assumed the shape of a long narrow stripe which ran perpendicular to the flow direction. The heater stripe warmed the surface at the point where the liquid exits the reservoir and enters the hydrophilic stripe. Various hydrophilic liquid samples (e.g. polydimethylsiloxane, glycerol, or tetraethylene glycol) were each deposited onto a different reservoir pad and the liquids spread in a predictable and controllable fashion. The liquid speed was found to be well correlated to the power applied to the resistor (which determines the temperature difference between the heated and the cooled sample edge), the width of the hydrophilic stripe and the volume of liquid deposited. Higher power inputs, wider hydrophilic stripes, thicker rivulets and larger sample volumes produced faster flow rates. Liquids with lower viscosity or stronger variation of surface tension, y with temperature T (i.e. higher $d\gamma/dT$) produced correspondingly faster speeds.

Example III

A prototypes for the microfluidic routing device depicted in FIG. 1*a* has been fabricated using the following process steps:

1. Cleaning of a 2-by-2 inch piece of Corning 1737 glass with a thickness of 0.7 mm by rinsing with (or ultrasonication in) tetrachlorethylene, acetone and isopropanol.
2. Further cleaning by immersion into a mixture of sulfuric acid, hydrogen peroxide and deionized water at a temperature of 80° C. for 20 minutes.
3. Spin coating of a layer of photoresist (AZ5214 at 4000 rpm for 40 seconds), exposure to UV radiation in a Karl Suess MJB3 mask aligner with a photolithographic mask for the heating electrodes and development of photoresist using Clariant 400k developer.
4. Evaporation of 120 nm thick layer of Ti, a 100 nm thick layer of Au and a 5 nm thick layer of Cr using a Denton electron beam evaporator
5. Removal of resist by immersion into acetone, which leaves the desired metal heater and contact pads on the surface.
6. Deposition of a 600–800 nm thick silicon dioxide layer by plasma enhanced chemical vapor deposition using a Plasmatherm 790 at a temperature of 250° C. with electrical contacts masked.
7. Spin-coating of a layer of photoresist (AZ5214 at 4000 rpm for 40 seconds), exposure to UV radiation in a Karl Suess MJB3 mask aligner with a photolithographic mask for straight parallel hydrophilic channels and development of the photoresist using Clariant 400k developer.
8. Immersion of sample in a dilute (1 mM) solution of 1H,1H,2H,2H-perfluorooctyltrichlorosilane in dodecane for 5 min.
9. Removal of sample from solution and sonication of sample in dodecane for 1–5 minutes.
10. Drying of sample in filtered nitrogen stream following by a water rinse.
11. Rinsing of sample with acetone to remove photoresist.
12. Immersion of sample in Bakerstrip 1000 at a temperature of 60° C. for 5 minutes.
13. Rinsing of sample with acetone and isopropanol.
14. Removal of silicon dioxide and Cr on top of contact pads using chromium etchant CR-7.
15. Optional soldering of contact pads with In-solder.
16. Cleaning of hydrophilic regions with a dilute solution of sulfuric acid and hydrogen peroxide in deionized water.
17. Powering heater resistor with DC-power supply and alligator clips attached to the device.
18. Sample placed on water cooled brass block which acts as heat sink.

It is to be understood that the above-described embodiments are illustrative of only a few of the many possible specific embodiments which can represent application of the principles of the invention. Numerous and varied other arrangements can be readily devised in accordance with these principles by those skilled in the art without departing from the spirit and scope of the invention.

What is claimed is:

1. A method for routing a liquid comprising the steps of:

receiving said liquid on a patterned surface having an open architecture, said patterned surface comprises one or more hydrophobic portions confining a hydrophilic surface to form a pathway; and individually activating one or more heating elements, wherein said heating elements are in registry with said patterned surface for selectively heating said patterned surface under conditions effective for routing said liquid along said hydrophilic surface and said one or more hydrophobic portions confines said liquid in said hydrophilic surface.

2. A device for routing a liquid comprising:

a patterned surface having an open architecture, said patterned surface comprising one or more hydrophobic portions confining a hydrophilic surface to form a pathway;

one or more heating elements in registry with said patterned surface; and means for individually activating one or more of said one or more heating elements, for selectively heating of said patterned surface under conditions effective for routing said liquid along said hydrophilic surface and flow of said liquid is by thermocapillary shear stresses said one or more hydrophobic portions confines said liquid in said hydrophilic surface.

3. A method for dividing a stream of liquid comprising the steps of:

receiving said stream of liquid on a patterned surface having an open architecture, said patterned surface comprises one or more hydrophobic portions confining a hydrophilic surface to form a pathway; and individually activating one or more heating elements, wherein said heating elements are in registry with said patterned surface for selectively heating said patterned surface under conditions effective for dividing said stream of liquid into one or more droplets and said one or more hydrophobic portions confines said liquid in said hydrophilic surface.

4. A device for dividing a stream of a liquid comprising:

a patterned surface adapted for receiving said stream of liquid, said patterned surface having an open architecture comprising one or more hydrophobic portions confining a hydrophilic surface to form a pathway;

one or more heating elements in registry with said patterned surface; and means for individually activating one or more of said one or more heating elements, for selectively heating of said patterned surface under conditions effective for dividing said stream of liquid into one or more droplets and said hydrophobic portions confines said liquid in said hydrophilic surface.

5. A method for mixing two or more liquids comprising the steps of:

receiving said two or more liquids on a patterned surface, said patterned surface having an open architecture, said patterned surface comprising one or more hydrophobic portions confining a hydrophilic surface to form a pathway, each of said liquids being received in one of said pathways, said pathways being interconnected; and individually activating one or more heating elements, wherein said heating elements are in registry with said patterned surface for selectively heating said patterned surface under conditions effective for mixing said two or more liquids in at least one of said pathways and said one or more hydrophobic portions confines said liquid in said hydrophilic surface.

6. A device for mixing two or more liquids comprising:

a patterned surface, said patterned surface comprising one or more hydrophobic portions confining a hydrophilic surface to form a pathway, each of said liquids being received in one of said pathways, said pathways being interconnected;

one or more heating elements in registry with said patterned surface; and means for individually activating one or more of said one or more heating elements, for selectively heating of said patterned surface under conditions effective for mixing said two or more liquids in at least one of said pathways and said one or more hydrophobic portions confines said liquid in said hydrophilic surface.

7. A method for detecting an airborne material in gaseous, particulate or aerosol form comprising the steps of:

providing a substrate having an open architecture, said surface including chemical patterning on one or more portions of said surface to form one or more surface pathways;

selectively activating said heat source;

applying a liquid to said substrate and allowing said liquid to flow by thermocapillary shear stresses through activation of said heating source;

applying said airborne material to said substrate; and detecting said airborne material in said liquid, wherein said chemical patterning confines said liquid in said one or more surface pathways and said activated heat source provides selective movement of said liquid along said one or more surface pathways in a predetermined flow path.

8. The method of claim 7 wherein said heat source is positioned in registry with one or more source said reservoirs.

9. The method of claim 7 wherein said heat source comprises one or more heating elements.

10. The method of claim 7 wherein said airborne material is detected by liquid by becoming fluorescent.

11. The method of claim 7 wherein said airborne material is applied by a convective stream of said airborne material perpendicular to said one or more pathways.

12. A device for routing a liquid comprising:

a surface having an open architecture, said surface including chemical patterning on one or more portions of said surface to form one or more surface pathways;

heating elements in registry with said surface; and means for selectively activating said heating elements wherein said chemical patterning confines said liquid in said one or more surface pathways and said activated heating elements provide selective movement of said liquid along said one or more surface pathways by thermocapillary shear stresses in a predetermined flow path.

13. The device of claim 12 wherein each of said one or more surface pathways connect a source reservoir to a target reservoir.

14. The device of claim 12 further comprising a plurality of said surface pathways, each of said surface pathways connect a source reservoir to a target reservoir.

15. The device of claim 12 wherein a plurality of said pathways form a network including a first plurality of said surface pathways each having a source reservoir and a target reservoir and a second plurality of said surface pathways each having a source reservoir and a target reservoir, said first plurality of said surface pathways being interconnected to said second plurality of said surface pathways.

16. The device of claim 12 further comprising a plurality of first surface pathways connected perpendicularly to a second surface pathway, each of said first surface pathways and said second surface pathway having a source reservoir and a target reservoir.

17. The device of claim 12 wherein a plurality of said surface pathways are arranged radially from a source reservoir to a plurality of target reservoirs or from a plurality of source reservoirs to a target reservoir.

18. The device of claim 12 wherein said one or more surface pathways are rectilinear.

19. The device of claim 12 wherein said one or more surface pathways are curvilinear.

20. The device of claim 12 wherein said one or more surface pathways are sinuous.

21. The device of claim 12 wherein each of said one or more heating elements are associated with a cell, said cell including at least one transistor, said transistor being activated for activating said heating element of said cell.

22. The device of claim 12 wherein said cells are arranged in a matrix array.

23. The device of claim 12 wherein each of said surface pathways connects a source reservoir to a target reservoir and one said heating element is used for heating or cooling said source reservoir.

24. The device of claim 12 wherein said surface is formed on a substrate and said one or more heating elements are associated in registry with said substrate.

25. The device of claim 24 wherein a thermal insulation layer is coupled to an upper surface of said substrate and a bottom surface of said heating elements.

26. The device of claim 24 wherein an electrical insulation layer is coupled to an upper surface of said substrate and a bottom surface of said heating elements.

27. The device of claim 24 wherein an electrical insulation layer is coupled to an upper surface of said heating elements.

28. The device of claim 24 further comprising a passivation layer coupled to said substrate.

29. The device of claim 24 further comprising a planarization layer coupled to said one or more heating elements.

30. The device of claim 24 wherein said one or more heating elements are coupled to a first region of said substrate and a heat sink is coupled to a second region of said substrate.

31. The device of claim 24 wherein said activated one or more heating elements form a thermal map.

32. The device of claim 31 wherein said liquid is a continuous stream and activation of said thermal map divides said stream into an array of droplets.

33. The device of claim 32 wherein said droplets have equal size or unequal size.

34. The device of claim 31 wherein said liquid is one or more droplets and activation of said thermal map traps said one or more droplets.

35. The device of claim 34 wherein application of a second thermal map releases said trapped one or more droplets.

36. The device of claim 31 wherein activation of said thermal map initiates a reaction at one or more of said heating elements.

37. The device of claim 31 wherein activation of said thermal map quenches a reaction at said one or more heating elements.

38. The device of claim 12 wherein said chemical patterning comprises one or more hydrophobic portions confining a hydrophilic surface, said hydrophilic surface defining said one or more pathways wherein said liquid flows along said hydrophilic surface.

39. The device of claim 12 wherein a first said liquid is received in one of said surface pathways and a second said liquid is received in another of said surface pathways, said surface pathways being interconnected wherein flow of said liquid in said surface pathways mixes said first said liquid and said second said liquid.

40. The device of claim 39 wherein first said one or more heating elements apply a thermal gradient transverse to said surface pathways.

41. The device of claim 39 wherein second said one or more heating elements apply a thermal gradient parallel to said surface pathway.

42. The device of claim 12 wherein an airborne material in gaseous, particulate or aerosol form is absorbed in said liquid and further comprising:

means for detecting said absorbed material.

43. The device of claim 42 wherein said material is detected by fluorescence of said liquid upon contact with said material.

44. The device of claim 12 wherein said surface including chemical patterning has a flat topology.

45. The device of claim 12 further comprising one or more ridges in said surface including chemical patterning and said one or more surface pathways being defined respectively along said one or more ridges.

46. The device of claim 12 further comprising one or more indentations in said surface including chemical patterning, said one or more surface pathways being defined along said one or more indentations.

47. The device of claim 12 further comprising one or more grooves in said surface including chemical patterning said one or more surface pathways being defined respectively along said more grooves.

48. A method for routing a liquid comprising the steps of:

providing a surface having an open architecture, said surface including chemical patterning on one or more portions of said surface to form one or more surface pathways;

providing one or more heating elements in registry with said surface;

receiving said liquid on said surface; and selectively activating said heating elements wherein said chemical patterning confines said liquid in said one or more surface pathways and said activated heating elements by thermocapillary shear stresses provide selective movement of said liquid along said one or more surface pathways in a predetermined flow path.

49. The method of claim 48 wherein each of said one or more surface pathways connect a source reservoir to a target reservoir.

50. The method of claim 48 comprising a plurality of said surface pathways, each of said pathways connect a source reservoir to a target reservoir.

51. The method of claim 48 wherein a plurality of said surface pathways form a network including a first plurality of said surface pathways each having a source reservoir and a target reservoir and a second plurality of said surface pathways each having a source reservoir and a target reservoir, said first plurality of surface pathways being interconnected to said second plurality of surface pathways.

52. The method of claim 48 further comprising a plurality of first said surface pathways connected perpendicularly to a second surface pathway, each of said first surface pathways and said second surface pathway having a source reservoir and a target reservoir.

53. The method of claim 48 wherein a plurality of said surface pathways are arranged radially from a source reservoir to a plurality of target reservoirs or radially from a plurality of source reservoirs to a target reservoir.

54. The method of claim 48 wherein said one or more surface pathways are rectilinear.

55. The method of claim 48 wherein said one or more surface pathways are curvilinear.

56. The method of claim 48 wherein said one or more surface pathways are sinuous.

57. The method of claim 48 wherein each of said heating elements are associated with a cell, said cell including at least one transistor, said transistor being activated for activating said heating element of said cell.

58. The method of claim 57 wherein said cells are arranged in a matrix array.

59. The method of claim 57 wherein each of said one or more surface pathways connects a source reservoir to a target reservoir and one said heating elements is used for heating or cooling said source reservoir.

60. The method of claim 48 wherein said surface is formed on a substrate and said heating elements are associated in registry with said substrate.

61. The method of claim 60 wherein a thermal insulation layer is coupled to an upper surface of said substrate and a bottom surface of said one or more heating elements.

62. The method of claim 60 wherein an electrical insulation layer is coupled to an upper surface of said substrate and a bottom surface of said one or more heating elements.

63. The method of claim 60 wherein an electrical insulation layer is coupled to an upper surface of said one or more heating elements.

64. The method of claim 60 further comprising a passivation layer coupled to said substrate.

65. The method of claim 60 further comprising a planarization layer coupled to said one or more heating elements.

66. The method of claim 60 wherein said one or more heating elements are coupled to a first region of said substrate and a heat sink is coupled to a second region of said substrate.

67. The method of claim 48 wherein said activated one or more heating elements form a thermal map.

68. The method of claim 67 wherein said liquid is a continuous stream and activation of said thermal map divides said stream into a series of droplets.

69. The method of claim 68 wherein said droplets have equal size or unequal size.

70. The method of claim 67 wherein said liquid is one or more droplets and activation of a first said thermal map traps said one or more droplets.

71. The method of claim 67 wherein application of a second thermal map releases said trapped one or more droplets.

72. The method of claim 67 wherein activation of said thermal map initiates a reaction.

73. The method of claim 67 wherein activation of said thermal map quenches a reaction.

74. The method of claim 48 wherein said chemical patterning comprises one or more hydrophobic portions confining a hydrophilic surface, said hydrophilic surface defining said one or more pathways wherein said liquid flows along said hydrophilic surface.

75. The method of claim 48 wherein a first said liquid is received in one of said surface pathways and a second said liquid is received in another of said surface pathways, said surface pathways being interconnected, wherein flow of said liquid in said surface pathways mixes said first said liquid and said second said liquid.

76. The method of claim 75 wherein first said one or more heating elements apply a thermal gradient transverse to said surface pathways.

77. The method of claim 75 wherein second said one or more heating elements apply a thermal gradient parallel to said surface pathways.

78. The method of claim 48 wherein an airborne material in gaseous, particulate or aerosol form is absorbed in said liquid and further comprising the step of:

detecting said absorbed material.

79. The method of claim 78 wherein said material is detected by fluorescence of said liquid upon contact with said material.

80. The method of claim 48 further comprising the step of: storing said surface in glycerol.

81. The method of claim 48 further comprising the step of: applying a layer of glycerol on said surface.

82. The method of claim 74 further comprising the step of applying a layer of glycerol on said hydrophilic surface.

83. The method of claim 48 wherein said surface including chemical patterning has a flat topology.

84. The method of claim 48 further comprising one or more ridges in said surface including chemical patterning and said one or more surface pathways being defined respectively along said one or more ridges.

85. The method of claim 48 further comprising one or more indentations in said surface including chemical patterning, said one or more surface pathways being defined along said one or more indentations.

86. The method of claim 48 further comprising one or more grooves in said surface including chemical patterning said one or more surface pathways being defined respectively along said more grooves.

87. A device for detecting an airborne material in gaseous, particulate or aerosol form comprising:

a surface having an open architecture, said surface including chemical patterning on one or more portions of said surface to form one or more surface pathways;

applying a liquid to said substrate and allowing said liquid to flow by activation of said heating source;

selectively activating said heat source, wherein said chemical patterning confines said liquid in said one or more surface pathways and said activated heat source provides selective movement of said liquid along said one or more surface pathways by thermocapillary shear stresses in a predetermined flow path;

means for applying said airborne material to said network; and means for detecting said airborne material in said liquid.

88. A method for storing a device, said device comprising a device for detecting an airborne material in gaseous, particulate or aerosol form including a substrate having a network of one or more surface pathways on an upper surface of said substrate, said substrate having an open architecture, said substrate including chemical patterning on one or more portions of said surface to form one or more surface pathways, one or more heating elements in registry with said surface;

comprising the step of:

storing said device in glycerol.

89. A method for storing a device, said device comprising a device for detecting an airborne material in gaseous, particulate or aerosol form including a substrate having a network of one or more surface pathways on an upper surface of said substrate, said substrate having an open architecture, said substrate including chemical patterning on one or more portions of said surface to form one or more surface pathways, one or more heating elements in registry with said surface;

comprising the steps of:

applying a layer of glycerol on said patterned surface.

90. The device of claim 87 wherein said heat source is positioned in registry with one or more source said reservoirs.

91. The device of claim 87 wherein said heat source comprises one or more heating elements.

92. The device of claim 87 wherein said airborne material is detected by liquid by becoming fluorescent.

93. The device of claim 87 wherein said airborne material is applied by a convective stream of said airborne material perpendicular to one or more said surface pathways.

* * * * *

UNITED STATES PATENT AND TRADEMARK OFFICE

CERTIFICATE OF CORRECTION

PATENT NO. : 7,216,660 B2
APPLICATION NO. : 10/016294
DATED : May 15, 2007
INVENTOR(S) : Sandra M. Troian It is certified that error appears in the above-identified patent and that said Letters Patent is hereby corrected as shown below:

Col. Line 10, please add:

STATEMENT OF FEDERAL FUNDING

This invention was made with government support under Grant No. CTS9624776 & CTS0088774 awarded by the National Science Foundation. The government has certain rights in the invention.

Signed and Sealed this
Fourteenth Day of June, 2011

David J. Kappos

David J. Kappos
*Director of the United States Patent and Trademark Office*